US006581308B1

(12) United States Patent
Woerman et al.

(10) Patent No.: US 6,581,308 B1
(45) Date of Patent: Jun. 24, 2003

(54) HIGH CAPACITY BUCKET ARRANGEMENT

(75) Inventors: Gary R. Woerman, Wamego, KS (US); Philip M. Cioffi, Canadaigua, NY (US)

(73) Assignee: Caterpillar Inc., Peoria, IL (US)

( * ) Notice: Subject to any disclaimer, the term of this patent is extended or adjusted under 35 U.S.C. 154(b) by 358 days.

(21) Appl. No.: 09/905,705

(22) Filed: Jul. 25, 2000

Related U.S. Application Data

(60) Provisional application No. 60/220,801, filed on Jul. 25, 2000.

(51) Int. Cl.[7] ..... E02F 3/40
(52) U.S. Cl. ..... 37/444
(58) Field of Search ..... 172/272, 273; 37/403, 404, 405, 444, 466, 468; 414/697, 724, 723

(56) References Cited

U.S. PATENT DOCUMENTS

| | | | | |
|---|---|---|---|---|
| 829,829 A | | 8/1906 | D'Artenay | |
| 2,063,698 A | | 12/1936 | Roe | |
| 2,336,729 A | * | 12/1943 | Harris et al. | 228/182 |
| 3,860,131 A | * | 1/1975 | Borowski et al. | 37/444 |
| 4,077,140 A | | 3/1978 | Branconi | |
| 4,108,561 A | | 8/1978 | Kelley et al. | |
| 4,304,058 A | * | 12/1981 | Schwappach | 37/444 |
| 4,858,346 A | | 8/1989 | Schulte | |
| 5,040,900 A | | 8/1991 | Boggs | |
| 5,054,990 A | | 10/1991 | Schaeff | |
| 5,172,498 A | | 12/1992 | Wack | |
| 5,992,062 A | | 11/1999 | Evans et al. | |
| 6,108,951 A | * | 8/2000 | Renfrow et al. | 37/403 |

* cited by examiner

*Primary Examiner*—Robert E. Pezzuto
(74) *Attorney, Agent, or Firm*—James R Smith

(57) ABSTRACT

A high capacity bucket arrangement for a work machine having a pair of opposite side plates and a moldboard extending between, and attached to, the side plates. The trailing portion of a base plate is attached to the top portion of the moldboard, while the leading portion of the base plate is outwardly curved, relative to the bottom portion of the moldboard, which allows for a greater bucket capacity as well as the generated bucket breakout force.

13 Claims, 1 Drawing Sheet

HIGH CAPACITY BUCKET ARRANGEMENT

This application claims the benefit of U.S. Provisional Application No. 60/220,801 filed Jul. 25, 2000.

TECHNICAL FIELD

The present invention relates generally to a high capacity bucket arrangement. More particularly, this invention concerns a high capacity bucket for work machines and the like in which the base plate is provided with at least one curvilinear portion.

BACKGROUND ART

Typically, buckets for work machines such as hydraulic excavators, loaders, backhoes and the like typically utilize base plates to form, in part, a coupling juncture between the bucket and the hinge plates and also to form the upper leading portion of the bucket. The remaining upper portion of the bucket is typically attached to the trailing edge of the base plate the shape and orientation of which defines the shape and orientation of the remaining upper and rear portions of the bucket. The bucket shape constrains the base plate configurations and directly affects operating parameters such as bucket payload capacity. Other parameters which may be constrained by the base plate shape also include the ability to retain material in the bucket, the amount of breakout force generated, and the height of the torque tube in relation to the bucket which may hamper coupling of the hinge plates to the excavator stick.

Prior base plates typically comprise a planar straight structure which, when the bucket is coupled to the stick, is oriented at an angle greater than horizontal. Orienting the entire base plate at the aforementioned angle limits the size and shape of the remaining upper rear portion of the bucket. This results in the payload capacity being limited to the base plate-defined bucket shape. The present invention is directed to overcome one or more of the problems as set forth above.

DISCLOSURE OF THE INVENTION

In accordance with one aspect of the present invention, a bucket arrangement for a work machine is provided. The bucket arrangement includes a pair of opposite side plates, a moldboard, and a base plate. The moldboard extends between the side plates and has a bottom portion and a top portion. The base plate has a leading portion and a trailing portion with the trailing portion attached with the top portion of the moldboard. The leading portion is constructed to be curved, relative to the bottom portion of said moldboard, with a predetermined radius of curvature.

BEST MODE FOR CARRYING OUT THE INVENTION

Figure 1:
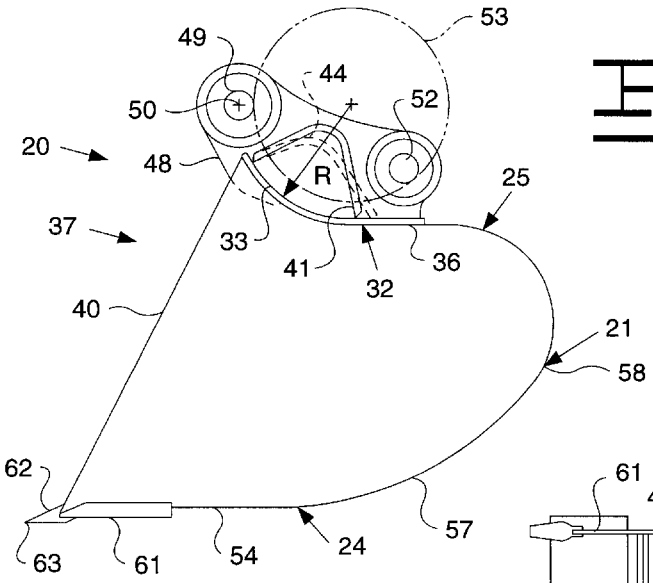
FIG. 1 is a diagrammatic side elevation view of an embodiment of the bucket arrangement of the present invention.
Figure 2:
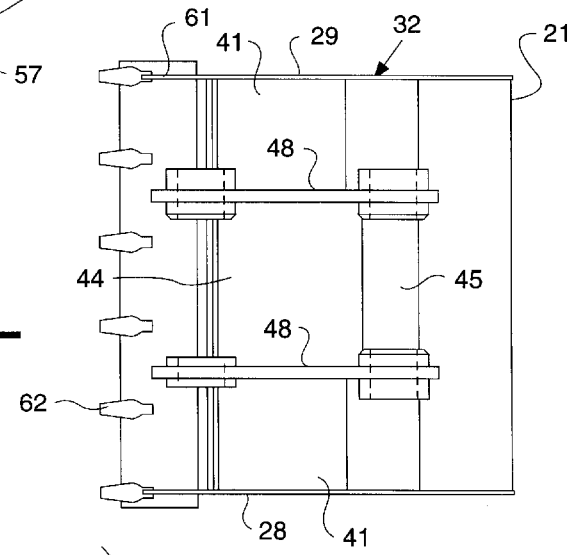
FIG. 2 is a diagrammatic top view of the bucket arrangement embodiment shown in FIG. 1.

Referring to FIGS. 1 and 2, a bucket arrangement embodying the principles of the present invention is generally shown at 20 for an excavating machine (not shown), such as a hydraulic excavator, loader, backhoe or the like.

The bucket arrangement 20 includes a moldboard 21 having a bottom portion 24 and top portion 25. The moldboard 21 is attached to and extends between a pair of opposite side plates 28,29. The bucket arrangement 20 also includes a base plate 32, preferably made of a rigid material, having a leading portion 33 and a trailing portion 36. As shown in FIG. 2, the base plate 32 has a length sufficient to substantially span the distance between the opposite side plates 28,29. In addition, the trailing portion 36 is attached, preferably by welding, to the top portion 25 of moldboard 21. The side plates 28,29, moldboard 21 and base plate 32 define, when arranged in the aforementioned manner, a bucket 37 having an opening 40. Also shown are outer and middle torque tubes 41,44 attached, preferably by welding, to the top surface 45 of the base plate 32.

Also shown are a pair of hinge plates 48 attached, preferably by welding, with the base plate 32. Each hinge plate 48 is adapted to receive a stick pin 49, having a stick pin center 50, and a link pin 52, both of a well-known type, which are used to couple the bucket arrangement 20 to, for example, an excavator stick (not shown). According to an embodiment of this invention, the leading portion 33 of base plate 32 is outwardly curved, relative to the bottom portion 24 of the moldboard 21, and has a preferred predetermined radius of curvature (designated herein as $\dot{R}$) such that the radius of curvature R defines a substantially concentric inner circle 53 (shown in phantom detail) which is substantially tangent to both the stick pin 49 and link pin 52.

The bottom portion 24 of the moldboard 21 may also include a substantially planar straight, in transverse cross-section, forward bottom portion 54 and a substantially upwardly curving bottom portion 57. As used herein, "upwardly curving" defines the shape of the moldboard 21 substantially between the forward bottom portion 54 and the moldboard rear portion 58, relative to the ground (not shown), when the forward bottom portion 54 is substantially adjacent to and parallel with the ground. Also shown is a cutting edge 61 which may be attached, in well-known ways, to the forward bottom portion 54. A plurality of teeth 62, each having a tip 63, may be attached with the cutting edge 61. As should be appreciated by those skilled in such art, providing the moldboard 21 with the aforementioned contour reduces contact between the bottom portion 24 and the ground which may result in reduced wear and longer service life of the moldboard 21. In accordance with an embodiment of the present invention, and as shown in FIG. 1, to provide the bucket 37 with increased capacity, it is preferred that the trailing portion 36 of the base plate 32 be substantially parallel with the forward bottom portion 54.

Figure 3:
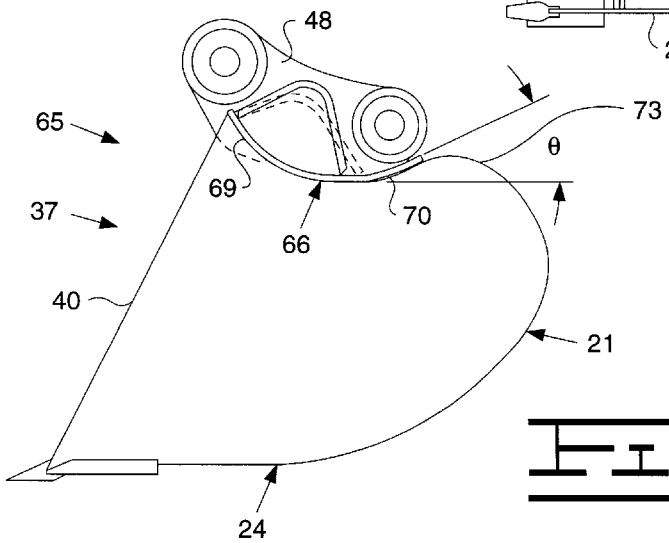
FIG. 3 is a diagrammatic side elevation view of another embodiment of the bucket arrangement of the present invention.

FIG. 3 shows an alternate embodiment of the bucket arrangement of the present invention base designated herein by reference numeral 65. Shown is a base plate 66 having the aforementioned radius of curvature R provided on the leading portion 69. The trailing portion 70 of the base plate 66 is formed to be angled outward, relative to the bottom portion 24, at a predetermined angle θ from the horizontal when the base plate 66 is attached to the moldboard 21 in the above-described manner. It is preferred that this angle θ be greater than zero (0) degrees from horizontal. As should also be appreciated by those skilled in such art, by providing the base plate 66 with an angled trailing portion 70, the top portion 25 of the moldboard 21 may be provided with a substantially upwardly bulging top portion 73, relative to the bottom portion 24, thereby effectively increasing the payload capacity of the bucket 37.

INDUSTRIAL APPLICABILITY

With reference to the drawings, and in operation, the base plate 32,66 couples a bucket 37 (defined by a moldboard 21, having a substantially straight forward bottom portion 54, and side plates 28,29) to the hinge plates 48. Providing the base plate 32 with a trailing portion 36 which is substantially parallel with the forward bottom portion 54 allows for a moldboard 21 having a deeper and higher (relative to the ground) moldboard top portion 25. By increasing bucket volume in this manner, the bottom portion 24 of the moldboard 21 may be provided with an upwardly curving bottom portion 57, thereby effectively increasing the useful life of the bucket 37 by minimizing the amount of abrasive contact between the moldboard 21 and the ground.

Furthermore, providing the base plate 32,66 with a leading portion 33,69 that is outwardly curved, relative to the bottom portion 24 of the moldboard 21, allows for nesting of the stick pin 49 closer to the bucket opening 40. This, in turn, may assist in maintaining material within the bucket 37 and increasing the generated bucket breakout force by effectively decreasing the tip radius (defined herein as the distance between the stick pin center 50 and tips 63). Additional useful advantages would include increased bending strength of the base plate 32,66 allowing for smaller torque tubes 41,44 and lower nesting of the middle torque tube 44 allowing for easier stick and link pins 49,52 coupling to, for example, an excavator stick (not shown). To further increase the payload capacity of the bucket 37, the base plate 32,66 may be provided with a trailing portion 70 that is angled outward, relative to the bottom portion 24 of the moldboard 21, at an angle greater than zero (0) degrees. Such an orientation of the trailing portion 70 may allow for a substantially upwardly bulging top portion 73 of moldboard 21 providing for an even greater bucket payload capacity.

As should be appreciated by those skilled in such art, an advantage of increasing the bucket payload capacity is that the time required for the work machine to move a set amount of material is decreased resulting in savings both in time and cost to complete a task. Other aspects, objects and advantages of this invention can be obtained from a study of the drawings, the disclosure and the appended claims.

What is claimed is:

1. A bucket arrangement for a work machine, comprising:

a pair of opposite side plates;

a moldboard extending between and attached to said side plates, said moldboard having a bottom portion and a top portion;

a base plate having a leading portion and a trailing portion, said trailing portion attached with said top portion of said moldboard and said leading portion being outwardly curved, relative to said bottom portion of said moldboard, and having a predetermined radius of curvature; and said bucket arrangement including a mouth, and said leading portion is structured and arranged for placement between said mouth and said trailing portion.

2. The bucket arrangement of claim 1 further comprising at least one hinge plate attached with said base plate, said hinge plate adapted to receive a stick pin and a link pin.

3. The bucket arrangement of claim 2 wherein said radius of curvature of said base plate defines a substantially concentric inner circle substantially tangent to both said stick pin and said link pin.

4. The bucket arrangement of claim 1 wherein said trailing portion of said base plate is angled outward, relative to said bottom portion, at a predetermined angle from horizontal.

5. The bucket arrangement of claim 4 wherein said angle is greater than zero degrees from horizontal.

6. The bucket arrangement of claim 1 wherein:

said bottom portion of said moldboard includes a substantially straight forward bottom portion; and said trailing portion of said base plate is substantially parallel with said forward bottom portion.

7. The bucket arrangement of claim 1 wherein said bottom portion of said moldboard includes:

a substantially straight forward bottom portion; and a substantially upwardly curving bottom portion, relative to the ground, when said forward bottom portion is substantially adjacent to and parallel with the ground.

8. The bucket arrangement of claim 1 wherein said top portion of said moldboard includes a substantially upwardly bulging top portion, relative to said bottom portion.

9. A bucket arrangement for a work machine, comprising:

a pair of opposite side plates;

a moldboard extending between and attached to said side plates, said moldboard having a bottom portion and a top portion;

a base plate having a leading portion and a trailing portion, said trailing portion attached with said top portion of said moldboard and said leading portion being outwardly curved, relative to said bottom portion of said moldboard, and having a predetermined radius of curvature; and a pair of hinge plates attached with said base plate, said hinge plate adapted to receive a stick pin and a link pin;

said bottom portion of said moldboard includes a substantially straight forward bottom portion;

said trailing portion of said base plate is substantially parallel with said forward bottom portion.

10. The bucket of claim 9 wherein said radius of curvature of said base plate defines a substantially concentric inner circle substantially tangent to both said stick pin and said link pin.

11. A bucket arrangement for a work machine, comprising:

a pair of opposite side plates;

a moldboard extending between said side plates, said moldboard having a bottom portion and a top portion;

a base plate having a leading portion and a trailing portion, said trailing portion attached with said top portion of said moldboard and said leading portion being outwardly curved, relative to said bottom portion of said moldboard, and having a predetermined radius of curvature; and a pair of hinge plates attached with said base plate, said hinge plate adapted to receive a stick pin and a link pin;

said trailing portion of said base plate is angled outward, relative to said bottom portion, at a predetermined angle from horizontal.

12. The bucket of claim 11 wherein said radius of curvature of said base plate defines a substantially concentric inner circle substantially tangent to both said stick pin and said link pin.

13. A bucket arrangement for a work machine, comprising:

a pair of opposite side plates;

a moldboard extending between and attached to said side plates, said moldboard having a bottom portion and a top portion;

a base plate having a leading portion and a trailing portion, said trailing portion attached with said top portion of said moldboard and said leading portion being outwardly curved, relative to said bottom portion of said moldboard, and having a predetermined radius of curvature; and a pair of hinge plates attached with said base plate, said hinge plate adapted to receive a stick pin and a link pin.

* * * * *